United States Patent [19]

Sheiry

[11] 4,446,345

[45] May 1, 1984

[54] SEAT SWITCH ASSEMBLY

[75] Inventor: William G. Sheiry, Roanoke, Va.

[73] Assignee: Eaton Corporation, Cleveland, Ohio

[21] Appl. No.: 379,593

[22] Filed: May 19, 1982

[51] Int. Cl.[3] ..... H01H 3/02

[52] U.S. Cl. ..... 200/85 R; 200/86 R

[58] Field of Search ..... 200/61.55–61.57, 200/85 R, 85 A, 86 R, 86 A

[56] References Cited

U.S. PATENT DOCUMENTS

| | | | |
|---|---|---|---|
| 3,544,746 | 12/1970 | Wolf et al. | 200/61.57 X |
| 3,670,120 | 6/1972 | Corn et al. | 200/61.55 |
| 3,704,352 | 11/1972 | Fontaine | 200/85 R |
| 3,715,541 | 2/1973 | Koenig | 200/86 R |
| 3,735,380 | 5/1973 | Wolf et al. | 200/85 A X |
| 3,838,236 | 9/1974 | Wolf et al. | 200/61.56 |

*Primary Examiner*—J. R. Scott

*Attorney, Agent, or Firm*—C. H. Grace; C. J. Toddy

[57] ABSTRACT

A seat switch assembly (11) which includes a ribbon switch (22) over which a corrugated actuating member (24) is laid, the assembly being imbedded within the bottom cushion (14) of the seat. The corrugations of the actuating member engage the ribbon switch at a plurality of spaced points and insure that the switch will be actuated by the weight of an operator applied at essentially any point on the bottom cushion.

4 Claims, 2 Drawing Figures

SEAT SWITCH ASSEMBLY

Figure 2:
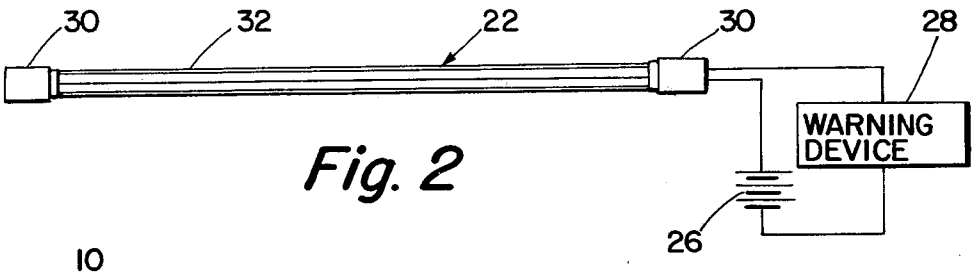

The present invention relates to switch mechanisms and more particularly to a switch assembly responsive to the presence of an operator on a vehicle seat.

In many industrial vehicles it is important that the vehicle not be operated unless an operator is in proper position upon the vehicle seat. It has thus become common to include a switch mechanism within the seat cushion to provide a signal indicative of the presence or absence of the operator. The actuation of the switch is then used in a variety of ways, including the closing of an alarm circuit if the vehicle is unoccupied under certain conditions, the disabling of an ignition circuit in an internal combustion engine powered vehicle, or to prevent the release of a parking brake if the vehicle is not occupied. It can be appreciated that a seat switch, whether normally open or normally closed can be used in a variety of applications wherein it is important to detect either an occupied condition or an unoccupied condition of the seat.

For the most efficient operation of a warning system or the like, as discussed above, it is important that seat switches have sufficient sensitivity to permit them to be actuated by relatively light operators as well as heavy ones; that the switch contact not be lost if an operator shifts his weight by leaning over, or if the vehicle bounces slightly; that the weight of the operator need not be applied to only a small, central area of the seat; and that the switch mechanism be tamper resistant.

Although there are many seat switches available and in use, it is difficult to provide a switch mechanism having all of the above characteristics and yet be sufficiently simple in construction that it can be provided at a reasonable price.

The present invention provides a seat switch mechanism which is of simple construction, and yet includes the above characteristics. Specifically, the invention provides a switch assembly which includes a commercially available ribbon switch of the type described in U.S. Pat. No. 3,694,600, supported by the frame of a seat cushion assembly and a corrugated actuator plate which is received over the ribbon switch. Padding and a suitable fabric covering is then applied in accordance with conventional seat construction practice to enclose the switch mechanism. The ribbon switch can be oriented either fore and aft or side-to-side on the seat with the corrugated actuator oriented accordingly. The actuator is placed on the switch such that a plurality of the corrugations contact the ribbon at spaced apart points. When the mechanism is in place, pressure corresponding to the weight of an operator applied at any point on the actuator plate will insure that the switch contacts close. Once the ribbon switch is closed, normal weight shifts concentrating the operators weight on different parts of the actuator plate are not likely to cause all of the corrugations of the actuator to break contact with the switch sufficiently to open the switch contacts. Also, normal bouncing of the operator which does not cause him to completely lose contact with the seat cushion is not likely to cause the ribbon switch to open.

Figure 1:
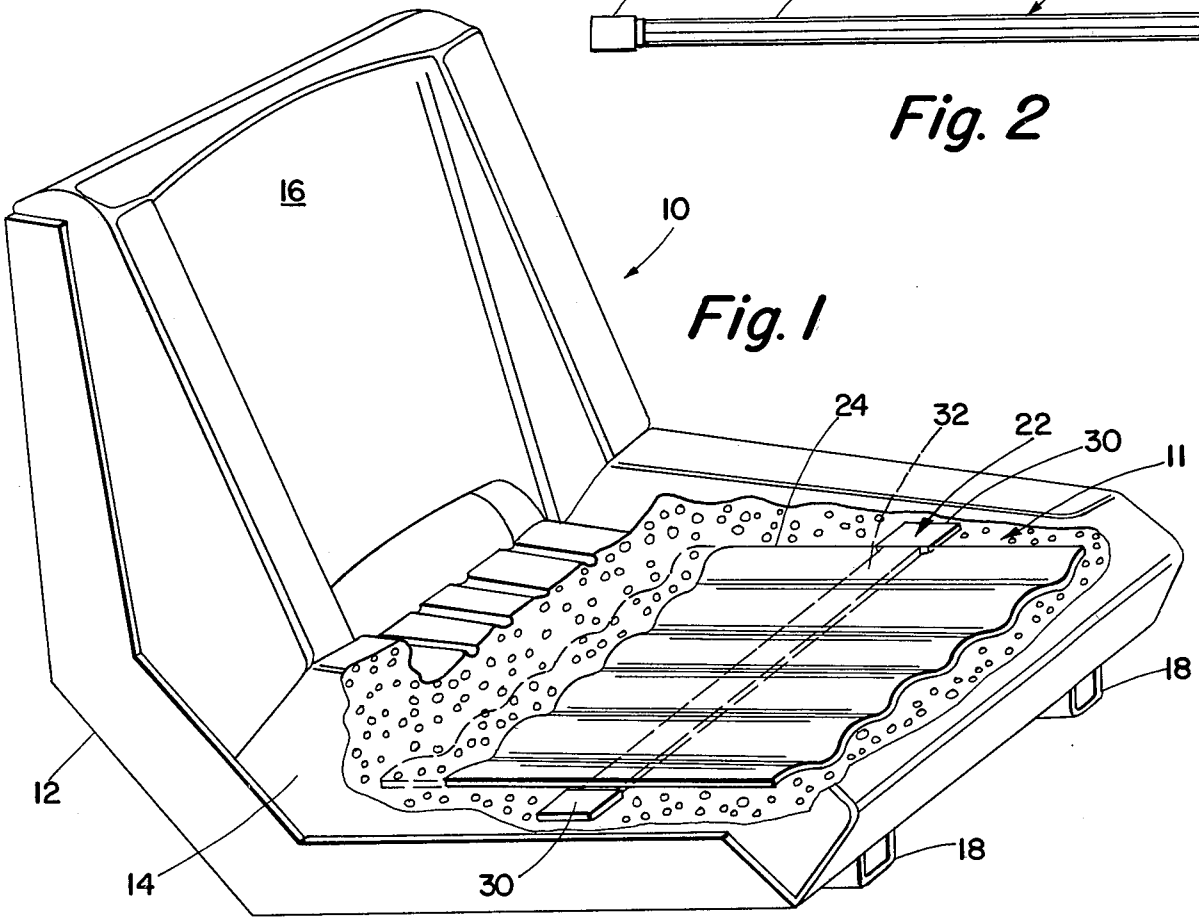

Other features and advantages of the invention will be apparent from the following description when considered in connection with the accompanying drawings, wherein:

FIG. 1 is a perspective view with a portion cut away of a vehicle seat incorporating the invention; and, FIG. 2 is a schematic diagram of an electrical circuit incorporating the invention.

Referring to FIG. 1 there is illustrated a vehicle seat 10, which inclues a frame 12, a bottom cushion 14 received within the frame 12, a back cushion 16 received within the frame 12, and mounting rails 18 attached to the frame and adapted for attachment to the frame of a vehicle.

The switch assembly, designated generally by the numeral 11, comprises a ribbon switch 22 which can rest directly on the bottom portion of frame 12, or which can be received on an intermediate baseboard (not shown), and a corrugated actuating member 24. As illustrated in FIG. 1, the bottom cushion is formed of a foam material, and the switch assembly 11 is embedded within the foam material.

Referring to FIG. 2, the switch 22 is shown connected in a simplified circuit which includes a battery 26 and a warning device 28. The warning device 28 is shown for illustrative purposes only and is intended to represent any one of a number of devices, such as an audible or visible alarm; an ignition disabling device or circuit, or a locking device to prevent the release of a parking brake or the like. The switch 22 could be normally open or normally closed depending on the actual circuit used; however, in the preferred embodiment, a normally open switch is used.

The switch 22 is a commercially available ribbon switch available from Granszow Inc. of Charlotte, N.C., and comprises end portions 30 and an elongated actuating portion 32 which is completely enclosed within a sheath of plastic or the like. The switch can be actuated by pressure applied anywhere along the actuating portion 32.

The corrugated actuating member 24 is substantially rectangular in plan view and rests on the actuating portion 32 of the switch. The actuating member has a projected area which is only slightly less than the seating surface area of the bottom cushion, thus insuring that the switch will be actuated by the weight of an operator applied at essentially any point on the bottom cushion 14. It is only necessary that at least one of the corrugations of the actuating member transmits sufficient force to the switch to actuate it. The switch 22 is available in various lengths and with various actuating pressure requirements; therefore, a switch can be selected to suit various seats, and an optimum pressure requirement can be selected to insure that the switch will not be actuated by a force applied to the seat which is less than that represented by the weight of an operator. The actuating member 24 can be made of any suitably rigid material such as glass-fiber-reinforced plastic.

In the illustrated embodiment the seat switch assembly is oriented with the switch 22 extending across the width of the seat; however, it can be appreciated that the assembly can be oriented with the switch extending fore and aft and the actuating member 24 disposed accordingly.

I claim:

1. In combination with a seat comprising a frame and a bottom cushion supported by said frame, a switch assembly including a ribbon switch disposed horizontally across said bottom cushion, the improvement wherein said switch assembly includes a substantially rigid actuating member disposed above said ribbon switch and substantially coextensive with the length of said ribbon switch in a direction parallel to the length of said ribbon switch and of substantially greater length than the width of said ribbon switch in a direction across said ribbon switch, said actuating member having a plurality of spaced apart contact areas extending across and engageable with said ribbon switch, said actuating member having a projected surface area which is only slightly smaller than the surface area of said cushion, said switch being connected in an electrical circuit including a power source and a warning device, said warning device being activated by actuation of said ribbon switch due to a weight equivalent to the weight of an operator applied to said cushion.

2. An apparatus as claimed in claim 1 in which said actuating member comprises a sheet of corrugated material, the corrugations of which extend across said ribbon switch for engagement with the ribbon switch.

3. Apparatus as claimed in claim 1 or claim 2 in which said cushion is formed of a foam material and said switch assembly is embedded within said foam material.

4. Apparatus as claimed in claim 3 in which said actuating member comprises a plate member substantially rectangular in plan view.

* * * * *